US006199600B1

(12) United States Patent
Ahn et al.

(10) Patent No.: US 6,199,600 B1
(45) Date of Patent: Mar. 13, 2001

(54) APPARATUS FOR INJECTING WORKING LIQUID INTO MICRO-INJECTING DEVICE AND METHOD FOR INJECTING THE WORKING LIQUID

(75) Inventors: Byung-sun Ahn, Suwon (KR); Lavrishev Vadim Petrovich, Moscowskaya oblast; Dunaev Boris Nikolaevich, Moscow, both of (RU)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/432,416

(22) Filed: Nov. 2, 1999

(30) Foreign Application Priority Data

Nov. 3, 1998 (KR) ..... 98120475

(51) Int. Cl.[7] ..... B65B 21/02

(52) U.S. Cl. ..... 141/2; 141/5; 141/7; 141/18; 141/51; 141/59; 141/65; 141/82; 141/8

(58) Field of Search ..... 141/2, 4, 5, 7, 141/8, 18, 21, 45, 56, 59, 65, 67, 82; 347/85–87

(56) References Cited

U.S. PATENT DOCUMENTS 994,010 * 5/1911 Langmuir ..... 141/8
1,345,347 * 7/1920 Chaney ..... 141/7
1,922,458 * 8/1933 Schaeffer ..... 141/7
2,679,343 * 5/1954 Smith et al. ..... 141/7
3,282,306 * 11/1966 Greenhut ..... 141/7
4,061,163 * 12/1977 Decker et al. ..... 141/7
4,099,550 * 7/1978 Matsuzaki et al. ..... 141/51
4,480,259 10/1984 Kruger et al. .
4,713,925 * 12/1987 Kafkis ..... 141/7
5,335,711 8/1994 Paine .
5,601,125 2/1997 Parsoneault et al. .

* cited by examiner

*Primary Examiner*—J. Casimer Jacyna
(74) *Attorney, Agent, or Firm*—Robert E. Bushnell, Esq.

(57) ABSTRACT

Disclosed is an apparatus for injecting working liquid into a micro-injecting device and a method for injecting the working liquid into the micro-injecting device. A container filled with the working liquid is in a vacuum chamber connected to a vacuum device, a plurality of cartridges having micro-injecting devices are inserted into the container and the working liquid in the container is filled into heating chambers of each micro-injecting device. Accordingly, the total manufacturing processes can be simplified so as to increase a production yield and the total manufacturing time of the products can be reduced.

17 Claims, 5 Drawing Sheets

APPARATUS FOR INJECTING WORKING LIQUID INTO MICRO-INJECTING DEVICE AND METHOD FOR INJECTING THE WORKING LIQUID

CLAIM OF PRIORITY

This application makes reference to, incorporates the same herein, and claims all benefits accruing under 35 U.S.C. §119 from an application for APPARATUS FOR INJECTING WORKING LIQUID INTO MICRO-INJECTING DEVICE AND METHOD FOR INJECTING THE SAME earlier filed in the Russian Federation on the 3rd of Nov. 1998 and there duly assigned Ser. No. 98120475.

BACKGROUND OF THE INVENTION

1. Field of the Invention

The present invention relates to the field of micro-injecting devices and ink jet print heads, particularly to membrane-type micro-injecting devices, and more particularly to the method of filling these devices with working fluid.

2. Description of the Related Art

Generally, a micro-injecting device refers to a device which is designed to provide printing paper, a human body or motor vehicles with a predetermined amount of liquid, for example, ink, injection liquid or petroleum using the method in which a predetermined amount of electric or thermal energy is applied to the above-mentioned liquid, yielding a volumetric transformation of the liquid. This method allows the application of a small quantity of a liquid to a specific object.

Recently, developments in electrical and electronic technology have enabled rapid development of such micro-injecting devices. Thus, micro-injecting devices are being widely used in daily life. One example of the use of micro-injecting devices in daily life is the inkjet printer.

The inkjet printer is a form of micro-injecting device which differs from conventional dot printers in the capability of performing print jobs in various colors by using cartridges. Additional advantages of inkjet printers over dot printers are lower noise and enhanced quality of printing. For these reasons, inkjet printers are gaining immensely in popularity.

An inkjet printer generally includes a printer head having nozzles with a minute diameter. In such an inkjet printhead, the ink which is initially in the liquid state is transformed and expanded to a bubble state by turning on or off an electric signal applied from an external device. Then, the ink so bubbled is injected so as to perform a print job on a printing paper.

Many methods and apparatuses for injecting working liquid are disclosed. In one type of micro-injection device, the printing operation on printing paper is executed using the vibration of a membrane, to drive the ink. In this type of device, a working liquid having the property of readily generating vapor pressure fills a heating chamber and induces the vibration. An example of this type of printhead is seen in U.S. Pat. No. 4,480,259, to Kruger et al., entitled Ink Jet Printer With Bubble Driven Flexible Membrane.

In a conventional method of filling such an inkjet printhead with working fluid, to continuously supply the working liquid into the inner portion of the heating chamber, a working liquid injecting device is installed on a portion of a cartridge, another portion of which is adjacent to the ink-jet printhead. Thus, the cartridge is attached to the inkjet printhead and the cartridge is filled with ink in the inner portion.

A method for injecting working liquid by using the working liquid injecting device will be now be described in detail. The working liquid stored in a working liquid reservoir is rapidly injected into the inkjet printhead according to a predetermined pressure applied by a pressurizing device (not shown). Then, the working liquid flows via a working liquid supply pipe into a working liquid supply channel through a supply hole and fills each heating chamber. In the mean time, the working liquid which remains after filling each heating chamber through the above-mentioned process is returned to a working liquid return unit via a working liquid return pipe. Then, the working liquid injection is finished by sealing the heating chambers.

However, the above-mentioned conventional method for injecting working liquid into the inkjet printhead has some problems. For the purpose of injecting the working liquid into each heating chamber, the separate and additional working liquid injecting devices are installed on the cartridge and the working liquid is injected into the separate inkjet printhead by using the separate working liquid injecting devices. Accordingly, total manufacturing time for manufacturing products increases and total manufacturing processes are complicated. Moreover, the total production yield decreases according to the complexity of manufacturing processes.

Examples of contemporary techniques for filling liquids in devices and moulds are seen in the following U.S. Patents. U.S. Pat. No. 5,601,125, to Parsoneault et al., entitled Vacuum Fill Technique For Hydrodynamic Bearing, describes a method for filling a hydrodynamic bearing with oil. U.S. Pat. No. 5,335,711 to Paine, entitled Process And Apparatus For Metal Casting, describes a process for casting molten metal into a mould involving subjecting the poured metal in the mould to pressure to reduce the porosity of the cast product. However, these techniques are not directly applicable to micro-injection devices.

SUMMARY OF THE INVENTION

It is therefore an object of the present invention to provide an improved method of filling an inkjet printhead with working fluid.

It is also an object of the invention to provide a less complicated method of filling an inkjet printhead with working fluid.

It is a further object of the invention to provide a method of filling an inkjet printhead with working fluid which requires less total manufacturing time.

It is a still further object of the invention to provide a method of filling an inkjet printhead with working fluid with improved production yield.

It is a yet further object of the invention provide a method of filling an inkjet printhead with working fluid without the use of a cartridge having a working fluid injection tool.

To achieve the above-mentioned objects and other advantages in the present invention, a container filled with working liquid is arranged in a vacuum chamber connected to an air supply/evacuation device; the air supply/evacuation device is operated after inserting a plurality of cartridges having inkjet printheads into the container; the inner environment of the vacuum chamber is evacuated; accordingly, the working liquid in the container simultaneously fills the heating chambers of each inkjet printhead.

Preferably, the vacuum pressure of the inner portion of the vacuum chamber is in the range of from approximately $2\times10^{-1}$ mm Hg to $2\times10^{-3}$ mm Hg. More preferably, the vacuum pressure is approximately $2\times10^{-2}$ mm Hg.

Also, an outer wall of the container is wound by a cooling medium flow pipe, and the cooling medium flow pipe cools down the working liquid container by means of a cooling medium in the pipe. Preferably, the cooling medium flowing in the cooling medium flow pipe is a gas; more preferably, a gas comprising mainly nitrogen is used as the cooling medium.

Accordingly, the total manufacturing time of manufacturing products can be reduced and the total production yield of the products is improved.

BRIEF DESCRIPTION OF THE DRAWINGS

A more complete appreciation of the present invention, and may of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
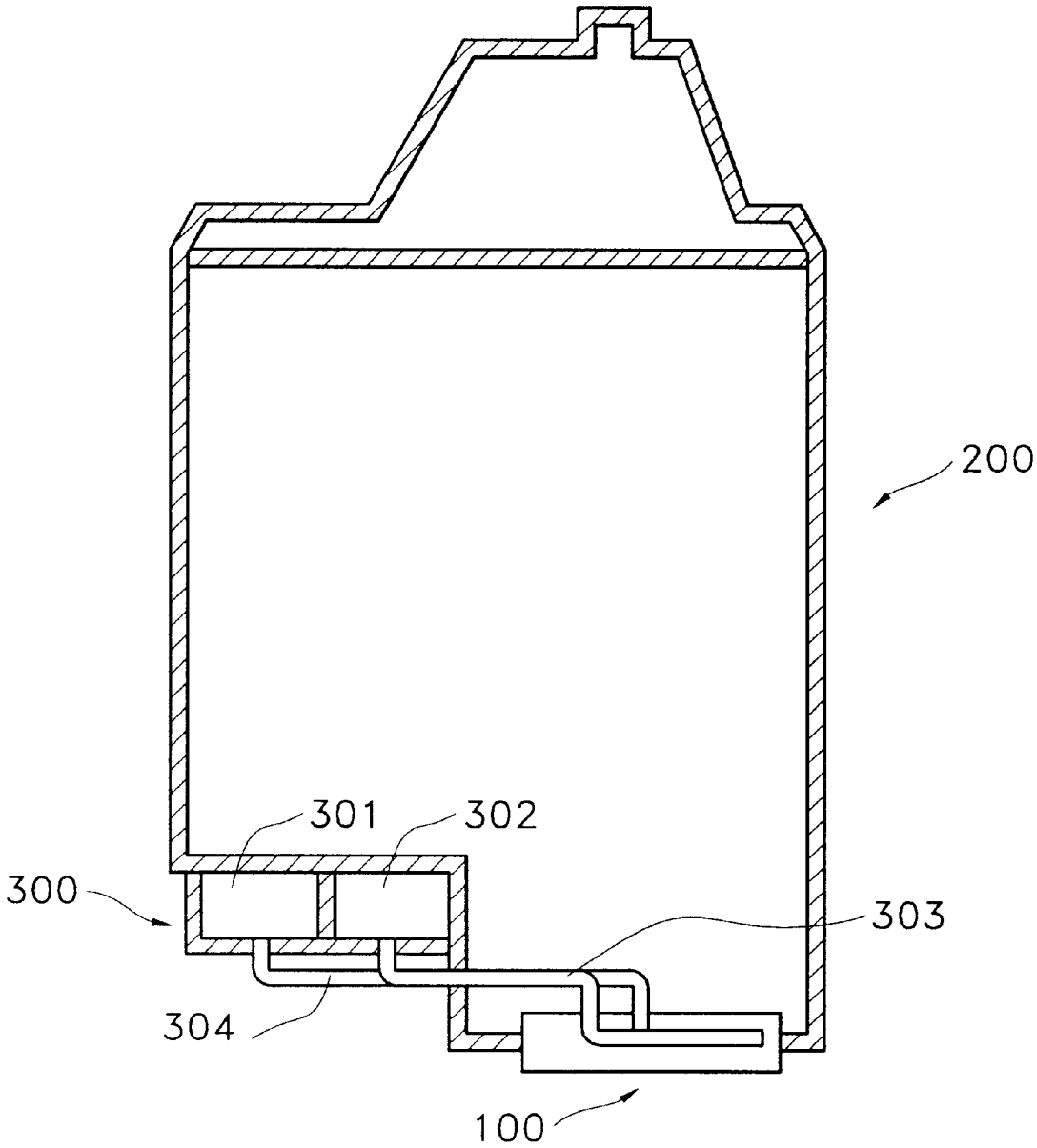
FIG. 1 (Prior Art)
FIG. 1 is a sectional view illustrating a shape of a cartridge having a conventional inkjet printhead.

Turning now to the drawings, the conventional method of filling a printhead with working fluid described above is shown in FIGS. 1 and 3. With reference to FIG. 1, to continuously supply the working liquid into the inner portion of the heating chamber 4 of a printhead (FIG. 3), a working liquid injecting device 300 is installed on a portion of a cartridge 200, another portion of which is adjacent to the inkjet printhead 100. Thus, the cartridge 200 is attached to the inkjet printhead 100 and the cartridge 200 is filled with ink in the inner portion.

Figure 3:
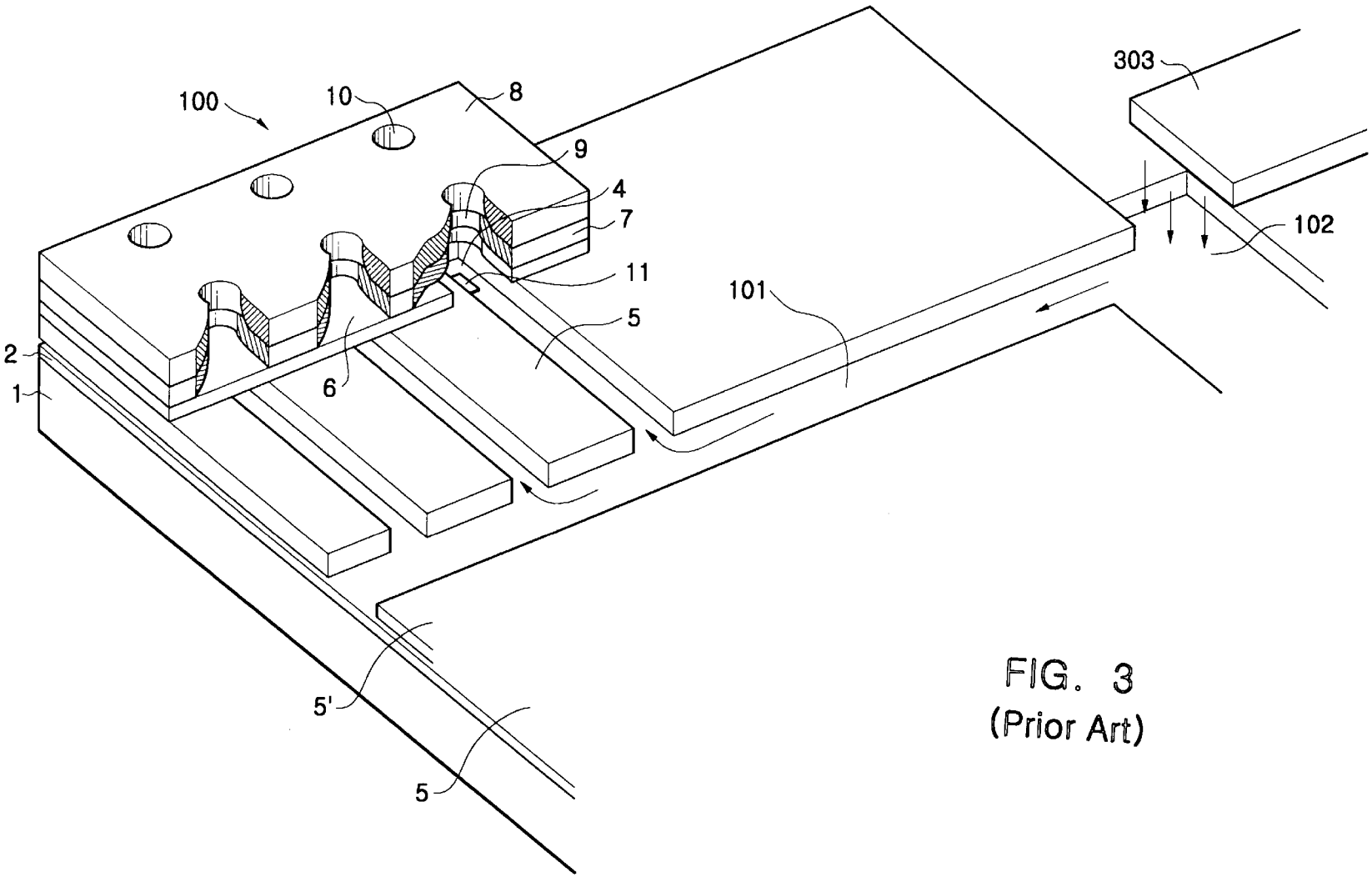
FIG. 3 (Prior Art)
FIG. 3 is a perspective view illustrating a heating chamber array of a conventional inkjet printhead.

A method for injecting working liquid by using the working liquid injecting device 300 will now be described in detail. The working liquid stored in a working liquid reservoir 302 is rapidly injected into the inkjet printhead 100 at a predetermined pressure applied by a pressurizing device (not shown). Then, the working liquid flows via a working liquid supply pipe 303 into a working liquid supply channel 101 through a supply hole 102 as shown in FIG. 3 and fills each heating chamber 4. In the mean time, the working liquid which remains after filling each heating chamber 4 through above-mentioned process is returned to a working liquid return unit 301 via a working liquid return pipe 304 as shown in FIG. 1. Then, the working liquid injection is finished by sealing the heating chambers.

The present invention will now be described in detail. The objects, characteristics and advantages of the present invention will be more clearly understood through the preferred embodiments with reference to the attached drawings.

Figure 2:
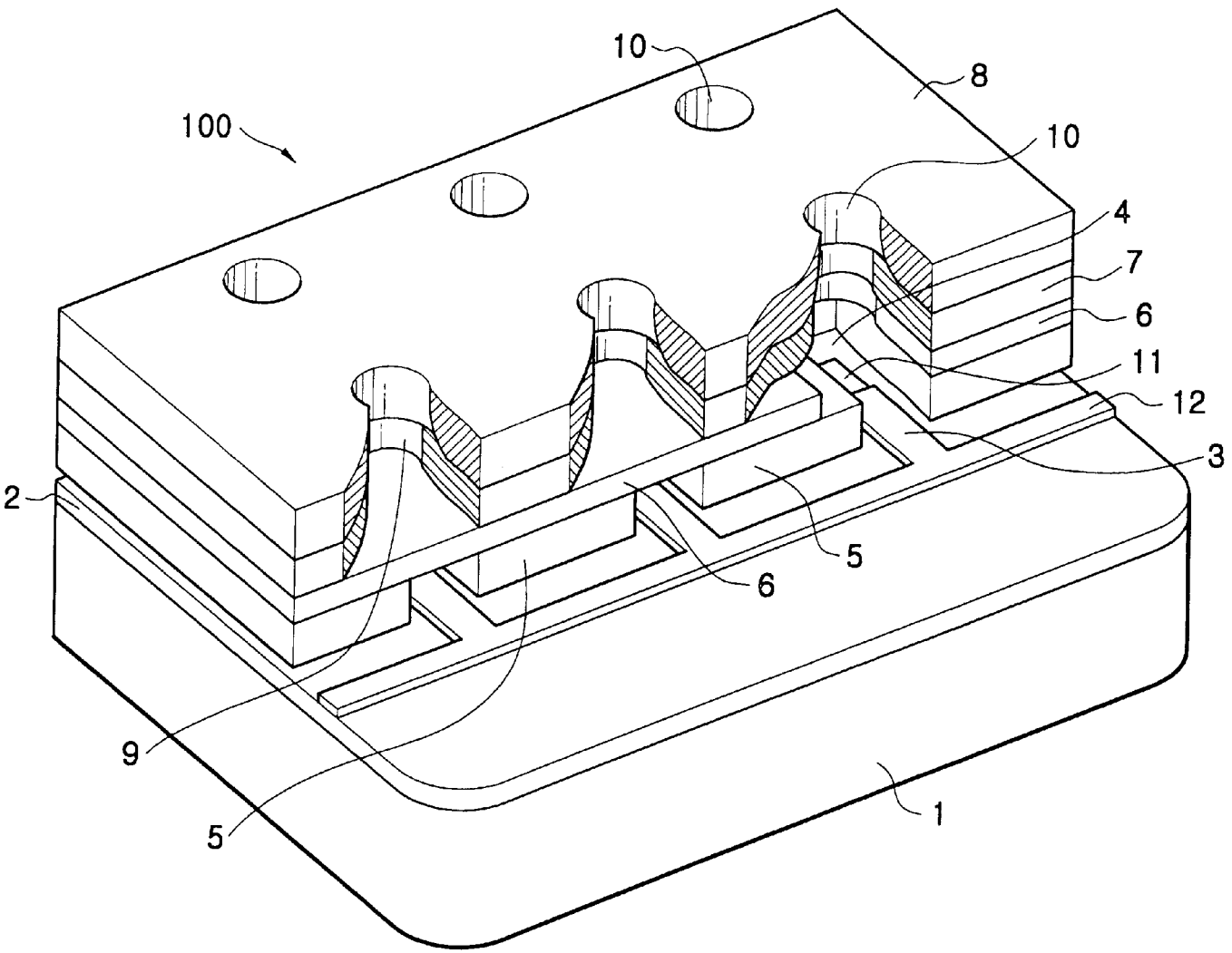
FIG. 2 is a perspective view illustrating a shape of an inkjet printhead applied to the present invention.

FIG. 2 is a perspective view illustrating the structure of an inkjet printhead which may be filled with working fluid by the present invention. As shown in FIG. 2, a thermal resistor layer 11 is formed on an upper portion of a protective layer 2 of a supporting substrate 1. An electrode layer 3 is formed on the thermal resistor layer 11 for supplying electric energy to the thermal resistor layer 11.

Here, the thermal resistor layer 11 converts the electric energy to the heat energy at a temperature in the range of 500 C to 550 C and transports the heat energy to a heating chamber 4 enclosed by a heating chamber barrier layer 5. A working liquid (not shown) having the property of easily generating vapor pressure fills the heating chamber 4.

In operation, the working liquid vibrates a membrane 6 formed on an upper portion of the heating chamber 4 and the stored ink in an ink chamber 9 enclosed by the ink chamber barrier layer 7 is ejected in drops outward via a nozzle 10 formed in a nozzle plate 8. Consequently, the printing operation is executed on an external printing paper.

Figure 4:
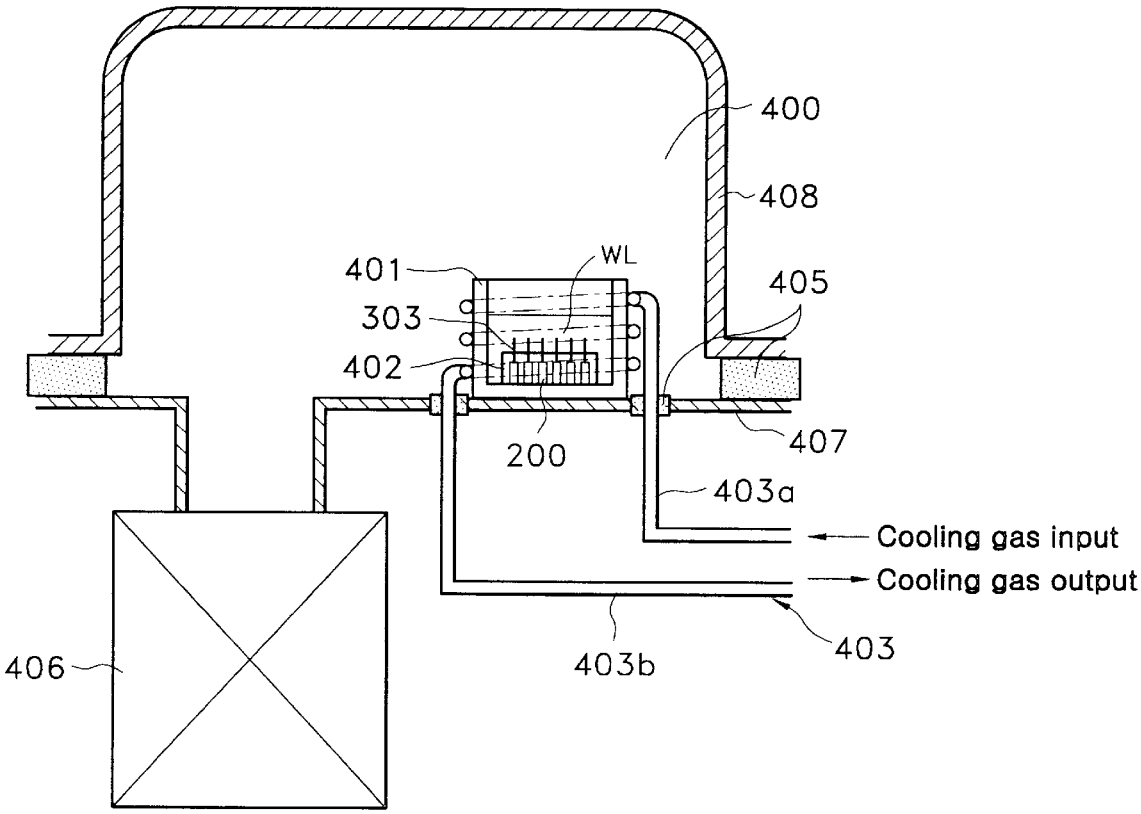
FIG. 4 is a view illustrating an apparatus for injecting working liquid into an inkjet printhead according to the present invention.

FIG. 4 is a view illustrating an apparatus for injecting working liquid into an inkjet printhead according to the present invention. A working liquid container 401 filled with the working liquid is arranged in an inside portion of a vacuum chamber 400. A cartridge-receiving container 402 having cartridges 200 is arranged in the working liquid. An outer wall of the working liquid container 401 is wound by a cooling medium flow pipe 403 and a plurality of inkjet printheads 100 are installed on each cartridge 200.

The cooling medium flow pipe 403 is separately installed from an inlet 403*a* for inflow into the vacuum chamber 400 and an outlet 403*b* for outflow to an outside portion of the vacuum chamber 400. A sealing unit 405 formed at a bottom surface 407 of the vacuum chamber 400 separates the vacuum chamber 400 into the inside and the outside, wherein the inlet 403*a* and the outlet 403*b* penetrate the bottom surface 407 of the vacuum chamber 400.

Moreover, the inside portion of the vacuum chamber 400 is separated from the outside by forming the sealing unit 405 at a boundary surface, wherein the bottom wall 407 and a top wall 408 are in contact.

Also, the vacuum chamber 400 is connected to an air supply/evacuation device 406. The air supply/evacuation device 406 serves not only for forming a vacuum in the inside portion of the vacuum chamber 400 by evacuating air from the inside portion of the vacuum chamber 400 but also serves for relieving the vacuum promptly in the inside portion of the vacuum chamber 400 by supplying air to the inside portion of the vacuum chamber 400.

Here, a plurality of cartridges loaded at a cartridge receiving container 402 and separated from outer working liquid are equipped with working liquid supplying pipes 303, which are exposed outward. The working liquid supplying pipes 303 provide a supplying path for the working liquid filled in the working liquid container to flow into the heating chambers 4 by connecting to the heating chambers 4 of the inkjet printheads 100 installed on the cartridges 200.

In a conventional inkjet printhead, when the working liquid is injected to the inkjet printhead, the working liquid is injected by the cartridge equipped with a separate, additional working liquid injecting device. Consequently, the production yield of products is markedly decreased.

By comparison, when the previously mentioned vacuum condition is provided, the working liquid in the working liquid container 401 is simultaneously injected to each heating chamber 4. Thus, the working liquid according to the present invention can be injected into each inkjet printhead 100 simultaneously by the above-mentioned working liquid injecting device. Consequently, efficient working liquid injection is possible without using a complex process, that is, without using the cartridge equipped with a separated and additional working liquid injecting device.

Figure 5:
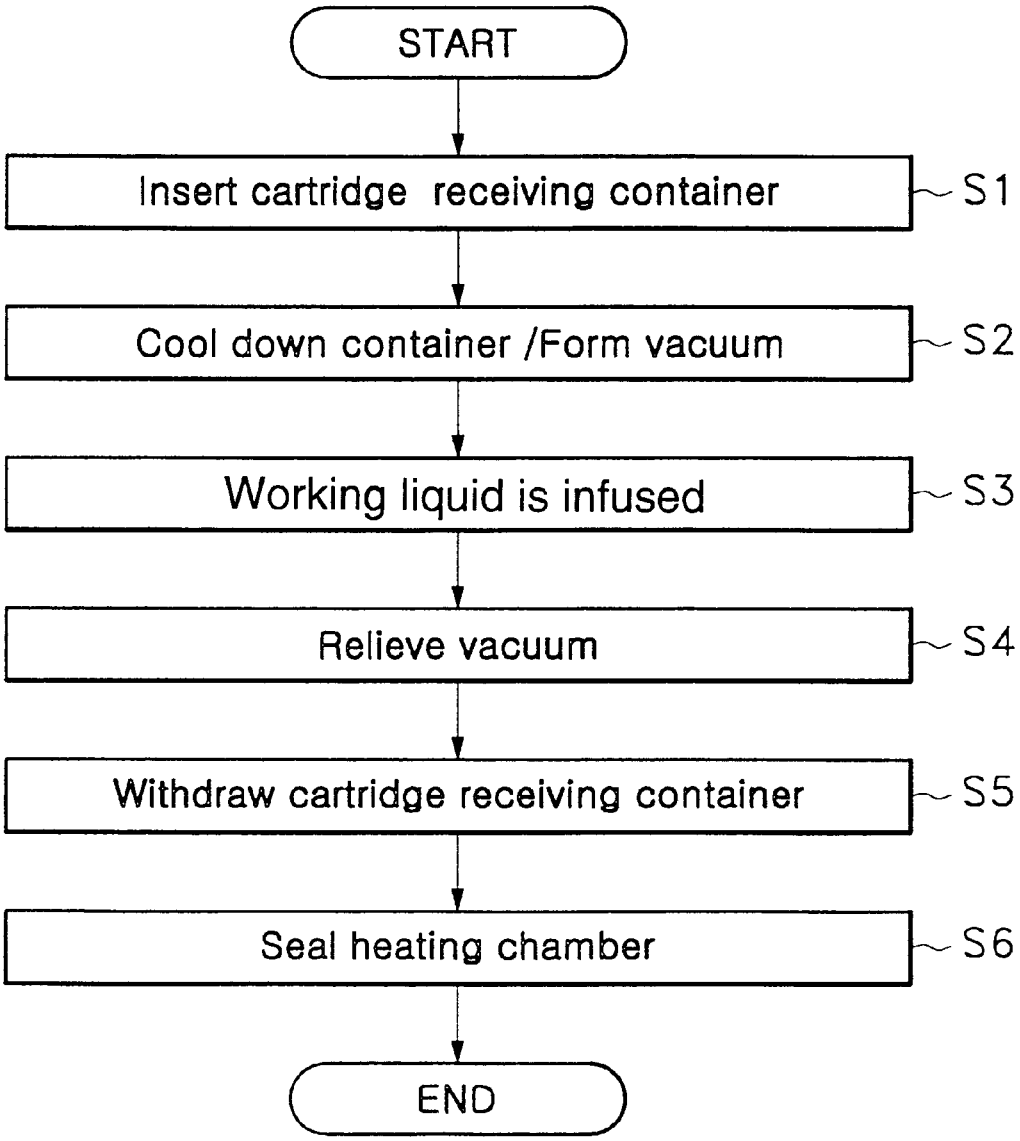
FIG. 5 is a flow chart illustrating a method for injecting working liquid into an inkjet printhead according to the present invention.

The method for injecting the working liquid by using the working liquid injecting device having above-mentioned structure according to the present invention will now be described in detail. is With reference to FIGS. 4 and 5, first, an operator collects a plurality of cartridges 200 having a plurality of inkjet printheads to be filled with working liquid and loads the cartridges 200 in a cartridge-receiving container 402. Then, the cartridge-receiving container 402 is inserted into the working liquid container 401 in the vacuum chamber 400 via a vacuum chamber door (not shown). Accordingly, an adequate quantity of the working liquid is placed in the working liquid container 401 (step S1).

Then, the operator continuously runs a cooling medium through the inlet 403*a* of the cooling medium flow pipe 403 (step S2). The purpose of the cooling medium is to cool down the temperature of an outer wall of the working liquid container 401 and to prevent the vaporization of the working liquid.

At this time, preferably, the above-mentioned cooling medium according to the present invention is a gas, preferably nitrogen gas or a gas comprising nitrogen. Generally, nitrogen gas is well known as a good refrigerant. By using the a nitrogen gas as a refrigerant, the outer wall of the working liquid container 401 is continuously cooled down to prevent the vaporization of the working liquid. The cooling medium flowing through the inlet 403*a* is continuously discharged to the outlet 403*b* via all lines of the cooling medium flow pipe 403.

In the mean time, the operator handles the air supply/evacuation device 406 for evacuating air in the vacuum chamber 400 in addition to flow process of the cooling medium. Accordingly, the air the vacuum chamber 400 is evacuated by the air supply/evacuation device 406. As a result, a low-pressure vacuum is formed in the inside portion of the vacuum chamber 400 (step S2). The vacuum-forming process and the cooling medium flow process are preferably executed simultaneously.

Then, the air filling the inside portion of the heating chambers 4 formed in the inkjet printhead 100 is evacuated by the air supply/evacuation device 406 along with the air in the inside portion of the vacuum chamber 400. In other words, at the same time as the air in the vacuum chamber 400 is discharged, the air in the heating chamber 4 is discharged to the vacuum chamber 400 by erupting as bubbles into the working liquid. Accordingly, the inside portion of the heating chamber 4 is vacated to allow for smooth entrance of the working liquid.

At this time, according to the characteristics of the present invention, the vacuum pressure of the inner portion of the vacuum chamber 400 is preferably adjusted to be in the range of from approximately $2\times10^{-1}$ mm Hg to $2\times10^{-3}$ mm Hg; more preferably, the vacuum pressure is approximately $2\times10^{-2}$ mm Hg.

In the mean time, as a result of executing above-mentioned processes, when the vacuum is formed in the vacuum chamber 400, the working liquid in the working liquid container 401 fully fills each heating chamber 4 by flowing into the vacant, evacuated space of the heating chambers 4. Accordingly, the working liquid is properly infused in the heating chambers 4 of the inkjet printheads 100, while the inkjet printheads 100 are installed on the cartridge 200 (step S3).

After the working liquid is fully injected into the heating chambers 4 of the inkjet printhead 100 through the above-described cooling medium flow process and the vacuum forming process, as a next step, the vacuum is relieved and the processes are finished by sealing each heating chamber 4 now filled with the working liquid.

When performing the injection of the working liquid into the heating chambers 4 of the injket printheads 100 through the above-mentioned processes, the operator handles the above-mentioned air supply/evacuation device 406 for supplying the air into the vacuum chamber 400. Accordingly, the vacuum in the vacuum chamber is relieved (step S4).

Then, the operator withdraws the cartridge-receiving container 402 loaded with a plurality of cartridges 200 equipped with a plurality of inkjet printheads 100 filled with the working liquid, to the outside portion of the vacuum chamber 400 through the vacuum chamber door (step S5).

Then, the operator seals the heating chambers 4 of each inkjet printhead 100 installed on the cartridges 200 by using an organic sealing material such as a polyimide thereby storing the working liquid safely in the sealed heating chambers 4 (step S6).

According to the present invention, the working liquid can be injected into the heating chambers of a plurality of inkjet printheads simultaneously. Accordingly, the production yield of the products is remarkably increased.

As aforementioned, the present invention can be applied to any micro-injecting device, for example, a micro pump of medical appliances and a fuel injecting device, etc., without any degradation of the efficiency. As the terms mentioned in the specification are determined based upon the function of the present invention, and they can be changed according to the technician's intention or a usual practice, the terms should be determined considering the overall contents of the specification of the present invention.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An apparatus for filling a micro-injecting device with working liquid, comprising:

a vacuum chamber;

air supply and evacuating means connected to the vacuum chamber for evacuating the vacuum chamber, for controlling the lowered pressure within the vacuum chamber, and for supplying air to the vacuum chamber for relieving the lowered pressure;

a working liquid container within the vacuum chamber for containing the working liquid; and a cartridge-receiving container for holding a cartridge with a plurality of micro-injecting devices, said cartridge-receiving container being insertable into the working liquid container.

2. The apparatus of claim 1, further comprising:

means for cooling the working liquid container.

3. The apparatus of claim 2, said means for cooling the working liquid container comprising:

a flow pipe in contact with the outer wall of the working liquid container and with the input and output portions of the flow pipe extending through a wall of the vacuum chamber for external supply of a cooling medium to the flow pipe.

4. The apparatus of claim 3, further comprising:

means for providing a gas to the flow pipe.

5. The apparatus of claim 1, said vacuum chamber further comprising:

a bottom wall having roughly a flat shape, a top wall having roughly a bell-jar shape, said top wall mounted on the bottom wall; and a sealing unit at the boundary between the top wall and bottom wall.

6. The apparatus of claim 1, further comprising:

a door in the vacuum chamber for providing access to the interior of the chamber.

7. The apparatus of claim 1, said cartridge further comprising:

a working liquid supply pipe disposed outward from the cartridge, for drawing working liquid from the working liquid container into the cartridge.

8. The apparatus of claim 7, further comprising:

a plurality of inkjet printheads, with unsealed heating chambers, disposed in the cartridge.

9. A method for filling a micro-injecting device with working liquid, comprising the steps of:

loading a cartridge with the micro-injecting device to be filled with the working liquid, placing the loaded cartridge into a cartridge-receiving container and placing the cartridge-receiving container in a working liquid container;

filling the working liquid container with working fluid;

cooling the working liquid container;

forming a vacuum of predetermined pressure surrounding the working liquid container;

relieving the vacuum surrounding the working liquid container;

withdrawing the cartridge-receiving container from the working liquid container; and sealing the heating chamber of the micro-injecting device.

10. The method of claim 9, further comprising:

installing the working liquid container in a vacuum chamber;

said step of forming a vacuum being performed by evacuating the air from the vacuum chamber; and said step of relieving the vacuum being performed by supplying air to the vacuum chamber.

11. The method of claim 9, said steps of cooling the working liquid and forming the vacuum being performed simultaneously.

12. The method of claim 9, said cooling of the working liquid container being performed by pumping a cooling medium through a flow pipe in contact with the outer wall of the working liquid container.

13. The method of claim 12, said cooling medium being a gas.

14. The method of claim 13, said gas comprising $N_2$.

15. The method of claim 9, said predetermined pressure of the vacuum being in the range of approximately $2\times10^{-1}$ to $2\times10^{-3}$ mm Hg.

16. The method of claim 15, said predetermined pressure of the vacuum being approximately $2\times10^{-2}$ mm Hg.

17. The method of claim 9, said step of sealing the heating chamber comprising using polyimide as a sealing material.

* * * * *